US006328418B1

(12) United States Patent
Yamada et al.

(10) Patent No.: US 6,328,418 B1
(45) Date of Patent: Dec. 11, 2001

(54) PRINT HEAD HAVING ARRAY OF PRINTING ELEMENTS FOR PRINTER

(75) Inventors: Takahiro Yamada; Hiroomi Kozawa; Takuji Torii; Kazunobu Hayashi; Toshitaka Ogawa; Satoru Tobita; Makoto Kurosawa; Kenji Yamada; Nobuhiro Noto; Osamu Machida; Katsunori Kawasumi; Hitoshi Kida; Mamoru Okano, all of Hitachinaka (JP)

(73) Assignee: Hitachi Koki Co., LTD, Tokyo (JP)

( * ) Notice: Subject to any disclaimer, the term of this patent is extended or adjusted under 35 U.S.C. 154(b) by 0 days.

(21) Appl. No.: 09/632,621

(22) Filed: Aug. 4, 2000

(30) Foreign Application Priority Data

Aug. 11, 1999 (JP) ..... 11-227197
Aug. 20, 1999 (JP) ..... 11-233542

(51) Int. Cl.[7] ..... B41J 2/15

(52) U.S. Cl. ..... 347/40; 347/12

(58) Field of Search ..... 347/40, 12, 9, 347/15, 43, 174; 318/502; 358/1.2

(56) References Cited

U.S. PATENT DOCUMENTS 5,079,571 * 1/1992 Eriksen ..... 347/40
5,793,392 * 8/1998 Tschida ..... 347/40
5,924,804 * 6/1999 Hino et al. ..... 347/40
5,929,879 * 7/1999 Karita et al. ..... 347/40
6,196,662 * 3/2001 Voelker et al. ..... 347/40
6,273,548 * 8/2001 Gruner et al. ..... 347/12

* cited by examiner

*Primary Examiner*—Thinh Nguyen
*Assistant Examiner*—Lamson D. Nguyen
(74) *Attorney, Agent, or Firm*—McGuireWoods LLP

(57) ABSTRACT

A print head for ink jet printer having a reduced length in a main scanning direction and an elongated length in an auxiliary scanning direction perpendicular to the main scanning direction. A plurality of linear print head modules are arrayed in the auxiliary scanning direction, and each linear print head module extends in a slanting direction with respect to the main scanning direction by a predetermined angle. Further, each linear print head module has a width in a direction perpendicular to its extending direction. The slanting angle and the width determine scanning pitch extending in the auxiliary scanning direction and can reduces the length of the print head in the main scanning direction.

11 Claims, 14 Drawing Sheets

MAIN SCANNING DIRECTION

MAIN SCANNING DERECTION

PRINT HEAD HAVING ARRAY OF PRINTING ELEMENTS FOR PRINTER

BACKGROUND OF THE INVENTION

The present invention relates to a print head having an array of printing elements such as nozzle array of an ink jet printer, and more particularly, to an elongated print head capable of providing a relatively wide band like imaging area upon a single scanning with respect to an image recording sheet. The present invention also relates to such print head for a multiple color ink jet printer capable of proving the relatively wide band like imaging area of multiple colors.

In a conventional serial scanning type ink jet printer for printing image on a continuous sheet, a band like image for one line is formed of a plurality of main scanning lines by moving the print head in a main scanning direction while ejecting ink therefrom, the main scanning direction being a lateral direction, i.e., widthwise direction of the continuous sheet, perpendicular to an auxiliary scanning direction, i.e., roll-out direction thereof. Then, the recording sheet is fed by a predetermined amount in the auxiliary scanning direction, and thereafter, the band like image for the next line is printed upon main scanning motion of the print head. By repeatedly performing the main scanning and auxiliary scanning motions, an image is formed on the sheet.

In case of a conventional color ink jet printer, also, a band like color image for one line is formed while ejecting inks of different colors such as cyan magenta, yellow and black from the nozzles in one way movement of the print head in the main scanning direction. That is, the plurality of main scanning lines for one line printing are the lines of different colors.

In order to increase the printing speed in the serial scanning type ink jet printer or color ink jet printer, the numbers of the main scanning lines, which perform imaging or color imaging upon a single main scanning operation of the print head, must be increased. To this effect, an elongated print head has been used where arranged are nozzle cells each formed with greater numbers of nozzle holes.

Further, in case of a high speed ink jet printer, an elongated line print head is used. Such elongated head has nozzle cells arranged on approximately full width of the continuous sheet, each nozzle cells being formed with necessary numbers of nozzles corresponding to necessary numbers of main scanning lines.

In order to provide the elongated print head, multiple nozzle cells are formed in a row extending in the line direction. In case of the color print head, rows of nozzle cells for different colors extends in the line direction and are arrayed side by side. However, such arrangement may lower productivity. Further, if only one of the nozzle cells may exhibit instable ink ejecting characteristic among multiple nozzle cells, the entire print head may lead to degradation in printing quality.

Another proposal is made to realize the elongated print head in which short length print head modules produced at high productivity are arrayed as disclosed in Japanese Patent publication No. Hei 3-5992. In case of the color printing, the arrays for different colors are provided side by side in the main scanning direction. The short length print head module provides high yieldability or productivity, and therefore, the combination of the short length print head modules can reduce production cost. However, this provide disadvantages as follows:

As shown in FIG. 4(*a*), a subordinate print head modules S are arranged in alternating staggered fashion in order to realize continuity of the nozzle holes in the auxiliary scanning direction of the resultant print head 510. Each subordinate print head module S includes a plurality of linear print head modules 1 arrayed side by side in the main scanning direction of the print head 510, and a distance between the neighboring subordinate print head modules S in the main scanning direction is greater than a width of the subordinate print head module S in the main scanning direction. Of course, instead of the subordinate print head modules S, the print head modules 1 can be arranged in alternating staggered fashion. However, in the latter case, the printing resolution may be dependent on the nozzle pitch of the print head module 1, or the resolution may be lower than a resolution estimated by the nozzle pitch. Accordingly, in order to provide high printing resolution, the above described subordinate print head modules S shown in FIG. 4(*a*) should be used, and these should be arrayed in the staggered fashion.

Similarly, in case of printing with two colors, as shown in FIG. 14(*a*), the above described subordinate print head modules S' are arrayed in the staggered fashion in a manner similar to the arrangement shown in FIG. 4(*a*), except that ink color of a first staggered array Si extending in the auxiliary scanning direction is different from an ink color of a second staggered array S2.

However, such staggered arrangement of the subordinate print head modules S or S', a width "Lj" of the print head in the main scanning direction is inevitably increased, and accordingly, nozzle array length in the main scanning direction is also increased. In particular, in case of a print head for four color printing, the four staggered arrays are required for four colors, and as a result, width "Lj" of the print head is more increased.

Thus, dot landing or impinging point on the continuous sheet may be varied due to variation in relative moving speed between the continuous sheet and the print head 510.

Specifically, in order to obtain high resolution print head 510, the subordinate print head module S must include a greater numbers of print head modules 1. Accordingly, the width of the subordinate print head module S in the main scanning direction must also be increased. Consequently, resultant width "Lj" in the main scanning direction of the print head 510 is increased to further increase nozzle array length in the main scanning direction. Thus, the problem of variation in dot landing point on the sheet becomes more serious.

Further, in addition to the above described problem of variation in dot landing point, the print head having increased nozzle array length in the main scanning direction provides another problem in terms of printing speed. The latter problem is particularly brought into attention in the serial scanning type printer.

That is, if the printing is to be performed to a position close to the widthwise end portions of the sheet by the serial scanning type printer having increased nozzle array length in the main scanning direction, the main scanning distance must be increased by the increased nozzle array length. More specifically, if the nozzle array length in the main scanning direction is increased, a leading end nozzle must be shifted largely out of the printing region in order to position a trailing end nozzle at the widthwise end portion of the sheet.

SUMMARY OF THE INVENTION

It is therefore an object of the present invention to overcome the above described drawbacks, and to provide an improved elongated print head capable of reducing nozzle array length in the main scanning direction yet providing high speed, high quality printing.

Another object of the invention is to provide such elongated print head produced at high productivity and yieldability.

These and other objects of the present invention will be attained by an print head for a printer, the print head providing a scanning line in a main scanning direction on a printing sheet, and including an improved plurality of linear print head modules. The plurality of linear print head modules are arrayed side by side in an auxiliary scanning direction perpendicular to the main scanning direction. Each linear print head module has a plurality of printing elements arrayed in a direction slanting the main scanning direction by an angle "θ" to provide an array of the printing elements. Each linear print head module has a width "t" perpendicular to the direction of the array of the printing elements, and the printing elements provide a first pitch "Po" between neighboring printing elements in the direction of the array and a second pitch "Ps" in the auxiliary scanning direction for defining scanning pitch on the printing sheet. The plurality of linear print head modules are also slanted by the angle "θ" with respect to the main scanning direction. The width "t" and the angle "θ" are defined by the following formulas:

$$(n-1)\frac{A}{2} < t \leq nA \quad \text{and}$$

$$\theta = \mathrm{Sin}^{-1}(Ps/Po)$$

where n is the numbers of printing elements, and $A=(Ps/Po)(Po^2-Ps^2)^{1/2}$. A distance between the neighboring linear print head modules in the auxiliary scanning direction is "nPs".

In another aspect of the invention, there is provided a print head for an ink jet printer, the print head providing a scanning line in a main scanning direction on a printing sheet, and including a plurality of nozzle cell arrays extending in a first direction slanting by an angle "θ" with respect to the main scanning direction and arranged side by side in an auxiliary scanning direction perpendicular to the main scanning direction. Each nozzle cell array include a plurality of nozzle cells aligned side by side in the first direction, and each nozzle cell provides an ink chamber formed with a nozzle, an ink inlet for directing an ink into the ink chamber, and a manifold for introducing the ink into the ink inlet. Each nozzle cell array is regarded as an imaginary linear print head module. Each imaginary linear print head module has a plurality of nozzles arrayed in the first direction by a combination of each nozzle of each nozzle cell. The imaginary linear print head module has a width "t" perpendicular to the first direction, and the plurality of nozzles provide a first pitch "Po" between neighboring nozzles in the first direction and a second pitch "Ps" in the auxiliary scanning direction for defining scanning pitch on the printing sheet. The width "t" and the angle "θ" are defined by the formulas described above. A distance between the neighboring imaginary linear print head modules in the auxiliary scanning direction is "nPs".

In still another aspect of the invention, there is provided a print head for a color ink jet printer, the print head ejecting first, second, and m-th kinds of color inks and providing a scanning line in a main scanning direction on a printing sheet. The print head includes a plurality of linear print head modules arrayed side by side in an auxiliary scanning direction perpendicular to the main scanning direction for ejecting "m" kinds of colors of different inks Each linear print head module has a plurality of nozzles arrayed in a slanting direction with respect to the main scanning direction by an angle "θ" to provide an array of the nozzles. The linear print head module has a width "t" perpendicular to the direction of the nozzle array. The nozzles provide a first pitch "Po" between neighboring nozzles in the direction of the nozzle array and a second pitch "Ps" in the auxiliary scanning direction for defining scanning pitch on the printing sheet, the plurality of linear print head modules are also slanted by the angle "θ" with respect to the main scanning direction. The width "t" and the angle "θ" are defined by the following formulas:

$$(n-1)\frac{A}{2m} < t \leq (n/m)A$$

and $$\theta = \mathrm{Sin}^{-1}(Ps/Po)$$

where n is the numbers of nozzles, and $A=(Ps/Po)(Po^2-Ps_2)^{1/2}$, and a distance between the neighboring linear print head modules for the identical color in the auxiliary scanning direction is "nPs", and (m−1) pieces of linear print head modules for (m−1) colors being positioned in the distance.

In still another aspect of the invention, there is provided a print head for a color ink jet printer, the print head ejecting first, second, and m-th kinds of color inks and providing a scanning line in a main scanning direction on a printing sheet. The print head includes a plurality of nozzle cell arrays extending in a first direction slanting by an angle "θ" with respect to the main scanning direction and arranged side by side in an auxiliary scanning direction perpendicular to the main scanning direction. Each nozzle cell array includes a plurality of nozzle cells aligned side by side in the first direction. Each nozzle cell provides an ink chamber formed with a nozzle, an ink inlet for directing an ink into the ink chamber, and a manifold for introducing the ink into the ink inlet, each nozzle cell array is regarded as an imaginary linear print head module. Each imaginary linear print head module has a plurality of nozzles arrayed in the first direction by a combination of each nozzle of each nozzle cell. The imaginary linear print head module has a width "t" perpendicular to the first direction, and the plurality of nozzles provide a first pitch "P" between neighboring nozzles in the first direction and a second pitch "Ps" in the auxiliary scanning direction for defining scanning pitch on the printing sheet. The width "t" and the angle "θ" are defined by the above described formulas for the print head for the color inkjet printer. A distance between the neighboring imaginary linear print head modules for the identical color in the auxiliary scanning direction is "nPs", and (m−1) pieces of imaginary linear print head modules for (m−1) colors are positioned in the distance.

In accordance with the present invention, an elongated print head extending in the auxiliary scanning direction with a reduced nozzle pitch in the main scanning direction can be produced at a low cost and with high yieldability or productivity. Such print head can reduce possibility of variation in landing of ink droplet onto the recording sheet due to variation in main scanning speed, thereby providing high quality image. Further, if the present invention is applied to a serial scanning type printer, scanning stroke can be reduced by a reduced amount of the nozzle array length because of the reduction in nozzle pitch. Thus, substantial printing speed can be increased.

BRIEF DESCRIPTION OF THE DRAWINGS

In the drawings:

FIG. 4(*b*) is a schematic plan view showing the print head according to the first embodiment for the purpose of comparison with FIG. 4(*a*);

FIG. 14(*b*) is a schematic plan view showing the print head according to the fourth embodiment for the purpose of comparison with FIG. 14(*a*);

DETAILED DESCRIPTION OF THE PREFERRED EMBODIMENTS

Figure 1:
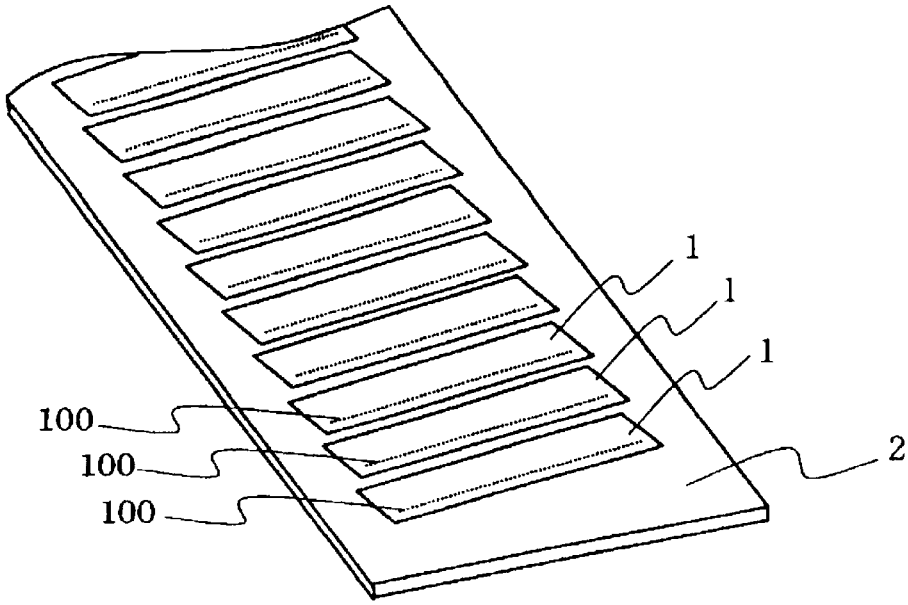
FIG. 1 is a perspective view showing a print head according to a first embodiment of the present invention.

An elongated print head for an ink jet printer according to a first embodiment of the present invention will be described with reference to FIGS. 1 through 6. The print head shown in FIG. 1 is oriented such that the illustrated side is in confrontation with a sheet.

The print head includes a holder 2 and a plurality of linear print head modules 1 held on the holder 2. These print head modules 1 are arrayed in a predetermined positional relationship and have structure equal to each other. Each print head module 1 is formed with "n" pieces of nozzles arrayed in a nozzle array 100 with a nozzle pitch Po (FIG. 3).

Figure 2:
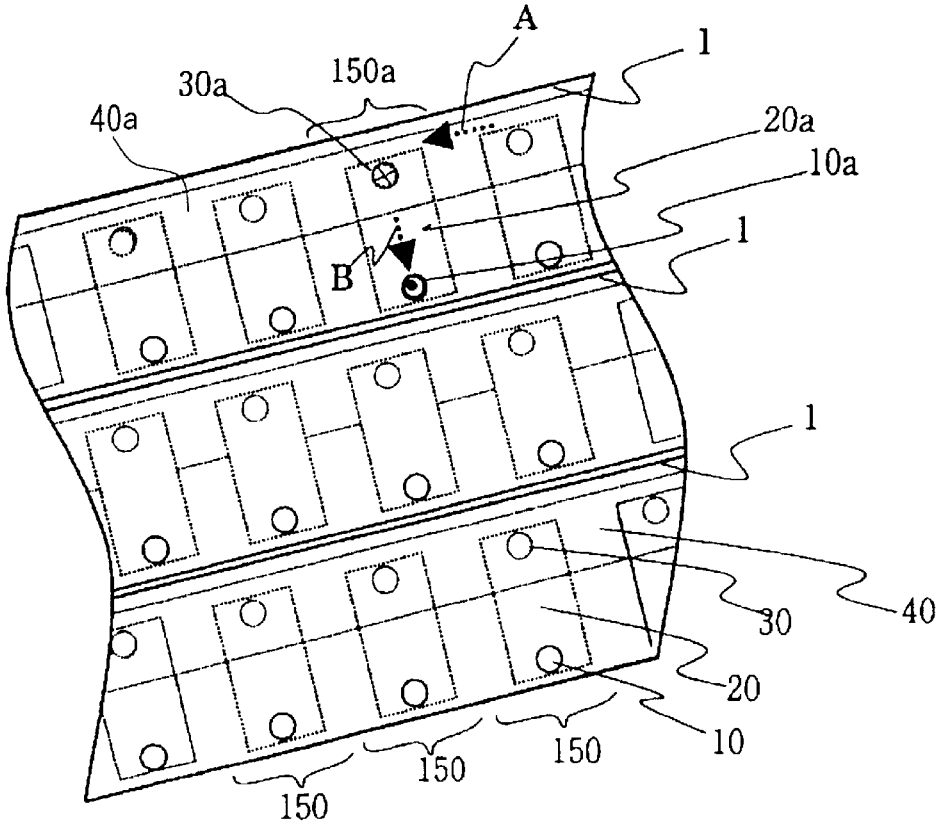
FIG. 2 is an enlarged view showing an essential portion of the print head of FIG. 1.

Enlarged 3 rows of linear print head modules 1 are exemplarily shown in FIG. 2. Each linear print head module 1 includes "n" pieces of nozzle cells 150 each formed with an opening of a nozzle 10, 10*a*. Each nozzle cell 150, 150*a* includes an ink chamber 20, 20*a* opened at the nozzle opening, an ink inlet hole 30, 30*a* for introducing ink into the ink chamber 20, 20*a*, and a manifold 40, 40*a* for supplying ink to the ink inlet hole 30, 30*a*. In the ink chamber 20, 20*a*, a driving element (not shown) such as a piezoelectric element is attached for changing an internal volume of the ink chamber 20, 20*a* in accordance with applied print signal. Each component is arranged in a direction perpendicular to the sheet of the drawing, and each nozzle cell 150, 150*a* has the same structure.

Operation of each nozzle cell 150, 150*a* will be described. For ejecting ink from the nozzle 10*a* for printing, internal volume of the ink chamber 20*a* is increased by the driving element (not shown), so that ink supplied into the manifold 40*a* in a direction indicated by an arrow A is flowed into the ink chamber 20*a* through the ink inlet hole 30*a*. Then, the internal volume of the ink chamber 20*a* is reduced by the driving element, so that the ink in the ink chamber 20*a* is directed toward the nozzle 10*a* in a direction indicated by an arrow B. Thus, the ink is ejected from the nozzle 10*a*. The ejected ink is landed on the sheet to form an image thereon during the relative scanning motion of the print head against the sheet.

Figure 3:
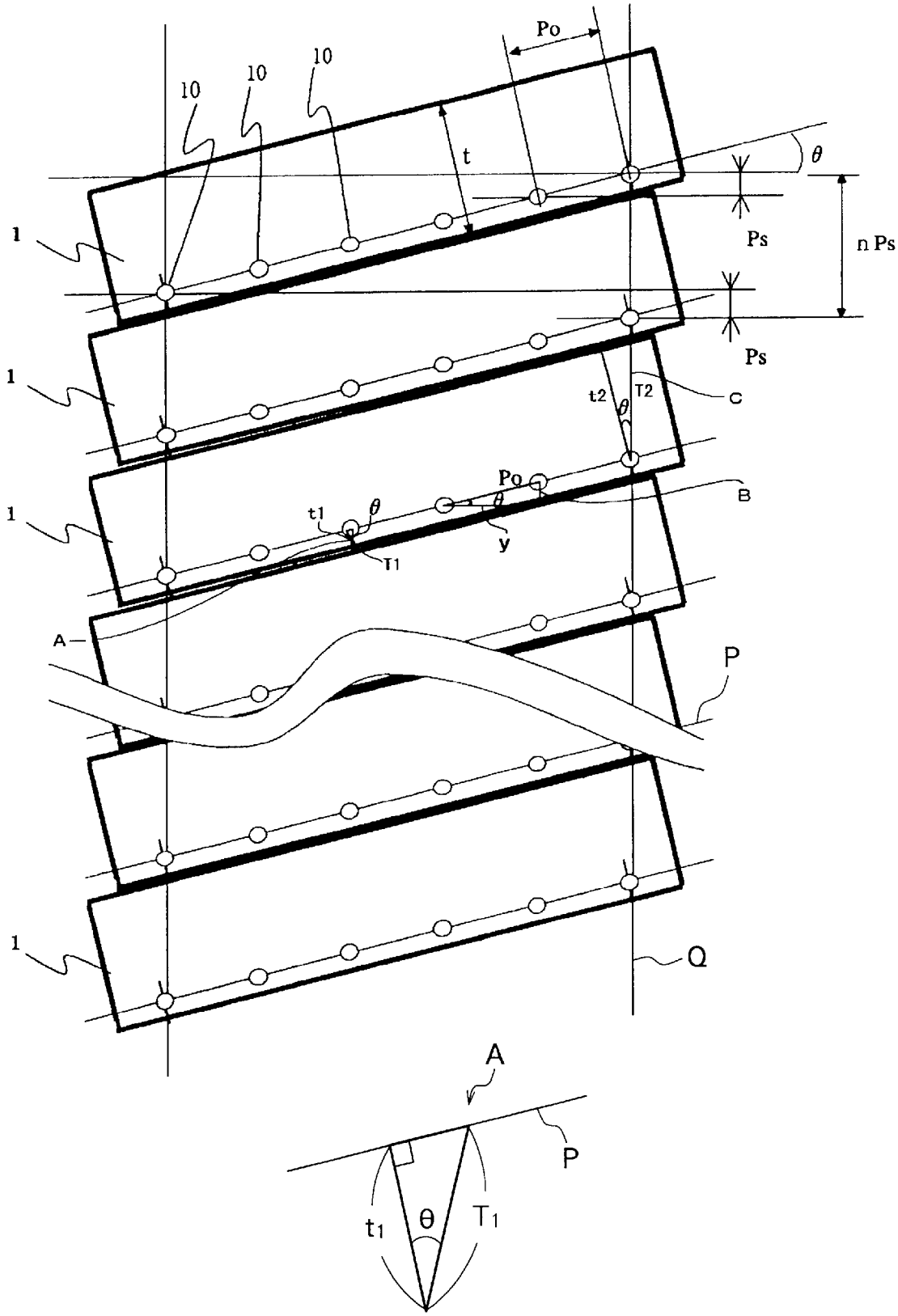
FIG. 3 is a schematic view showing an array of linear print head modules and dimension in the print head of the first embodiment.

Dimension and positional relationship of the linear print head modules 1 is shown in FIG. 3. The linear print head module 1 has generally rectangular shape and has a width "t" i.e., a minor side length of a rectangle. The print head module 1 is formed with "n" pieces of nozzles 10 (in FIG. 3, six nozzles are shown) spaced away from each other by an equal interval, i.e., a pitch length of "Po". The width "t" is determined by the following formula [1].

$$(n-1)\frac{A}{2} < t \leq nA \qquad [1]$$

Here, "A" is represented as follows:

$$A = \frac{Ps}{Po}\sqrt{Po^2 - Ps^2}$$

Further, in the linear print head module 1, the array of the nozzles 10 is slanted by an angle θ with respect to the main scanning direction. This inclination angle θ is:

$$\theta = \mathrm{Sin}^{-1}(Ps/Po)$$

Here, "Ps" designates a pitch (resolution) of the scanning lines to perform printing with the single main scanning of the print head. N pieces of the slanted linear print head modules 1 are arrayed in the auxiliary scanning direction with a pitch of "nPs". That is, a distance between the neighboring print head modules 1 in the auxiliary scanning direction is "nPs".

According to the print head, scanning lines with the pitch Ps can be provided by the ink ejection from each of the nozzles 10. The printed width in the auxiliary scanning direction is approximately N×(nPs). Thus, by increasing the numbers N of pieces of the linear print head modules 1, the elongated print head extending in the auxiliary scanning direction can result. In this way, in the present embodiment, the elongated print head can be provided by the combination of the linear print head modules 1 which is relatively easily produced with relatively small nozzle cells 150. Thus, the resultant print head can be produced with high yieldability or productivity.

Figure 4:
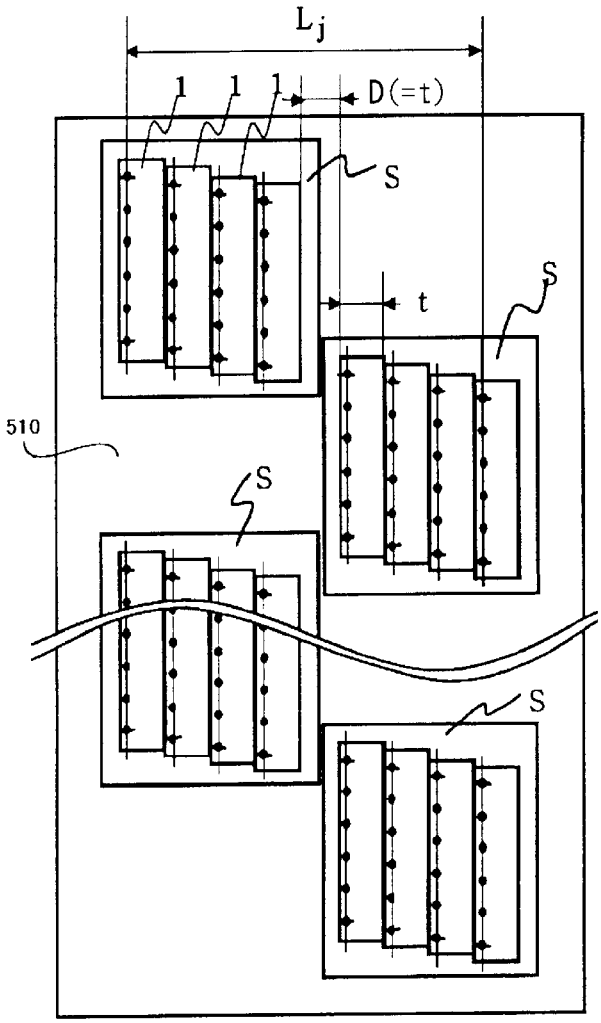
FIG. 4 (a) PRIOR ART
FIG. 4(*a*) is a schematic plan view showing a conventional print head.
Figure 4:
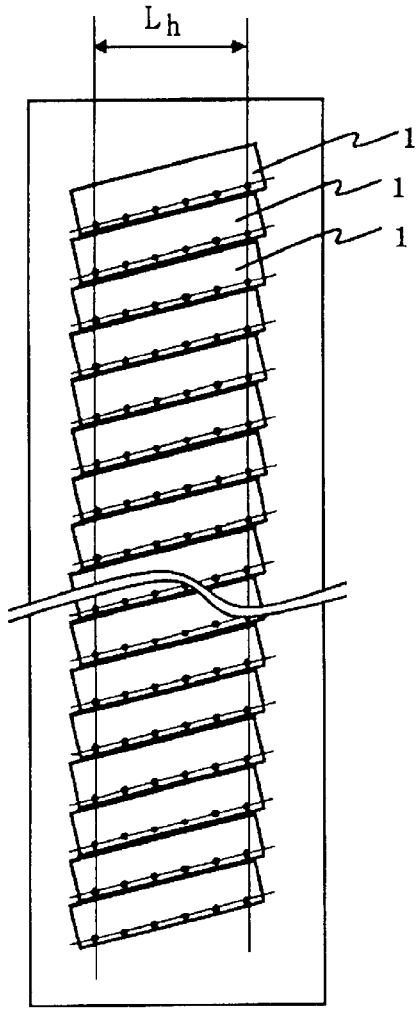

In FIGS. 4(*a*) and 4(*b*), for the purpose of comparison shown are the print head of the present embodiment and the print head in which linear print head modules 1 are arrayed in a conventional manner. Incidentally, both print heads provide the scanning pitch of "Ps", and the linear print head module 1 used in the conventional print head and the linear print head module 1 used in the present embodiment have the dimension and ink ejection characteristic the same as each other.

In FIG. 4(*a*), according to the conventional print head 510, four linear print head modules 4 are arrayed in the main scanning direction and displaced from each other in the auxiliary scanning direction so as to provide the scanning pitch of "Ps", thereby providing the subordinate print head module S. In order to provide continuity in nozzles in the auxiliary scanning direction, i.e., longitudinal direction of the print head, the subordinate print head modules S are arranged in alternating staggered fashion such that the distance between the neighboring subordinate print head modules S is greater than the width of the subordinate print head module S in the main scanning direction. Accordingly, an entire length "Lj" of the nozzle array in the main scanning direction becomes large.

On the other hand, according to the print head of the present embodiment shown in FIG. 4(*b*), the nozzle array length "Lh" in the main scanning direction is extremely smaller than the conventional length "Lj", and the length can be reduced to almost half the "Lj".

Here, a maximum length and a minimum length of the minor side "t", i.e., width of the linear print head module 1 is derived by the following manner. In FIG. 3, a line P connects nozzle openings of the identical linear print head module 1, and a line Q connects nozzle openings of the neighboring print head modules 1. Further, three right triangles A, B and C are shown. The right triangle A has a height "t1" extending perpendicular to the line P and a hypotenuse "T1" extending in parallel with the line Q, and intersecting angle θ defined between the height "t1" and the hypotenuse "T1". The right triangles A and B are similar triangles, and the right triangle B has a height "y" extending perpendicular to the line Q and a hypotenuse "Po" extending on the line P. Further, y can be represented by "$y=(Po^2-Ps^2)^{1/2}$". Therefore, the relationship of "t1/T1=y/Po" can be established. Thus, the following equation (1) can be provided:

$$T1=(t1\times Po)/y \tag{1}$$

On the other hand, the right triangles B and C are similar triangles, and the right triangle C has a height "t2" extending perpendicular to the line P and a hypotenuse "T2" extending on the line Q. Therefore, the relationship of "t2/T2=y/Po" can be established. Thus, the following equation (2) can be provided:

$$T2=(t2\times Po)/y \tag{2}$$

Here, a distance between the neighboring nozzles of the neighboring linear print head modules 1 in the auxiliary scanning direction is "nPs". Therefore, if this distance "nps" is smaller than (T1+T2), the linear print head modules 1 can be arranged side by side in the auxiliary scanning direction. Thus, the following inequality (3) can be established.

$$T1+T2\leqq nPs \tag{3}$$

With the equations (1) and (2), T1+T2=(t1+t2)×Po/y=t×Po/y. Accordingly, the following inequality (4) can established:

$$t\times Po/y\leqq nPs \tag{4}$$

Thus, "t" is represented as the following formula [2]:

$$t\leq n\frac{Ps}{Po}y=n\frac{Ps}{Po}\sqrt{Po^2-Ps^2} \tag{2}$$

On the other hand, in the conventional print head shown in FIG. 4(*a*), the subordinate print head module S includes (Po/Ps) pieces of linear print head modules 1 so that the scanning pitch can be "Ps" by using the linear print head module 1 where the nozzle pitch is "Po". Further, provided that the distance "D" between the trailing edge of the linear print head module 1 of the precedent subordinate print head module S and the leading edge of the linear print head module of the subsequent subordinate print head module S is "t", the entire width "Lj" of the conventional print head is as follows:

$$Lj=2\times(Po/Ps)\times t \tag{5}$$

On the other hand, the entire width "Lh" of the print head according to the present embodiment is;

$$Lh=(n-1)(Po^2-Ps^2)^{1/2}$$

The present embodiment provides advantage if the entire width "Lh" is smaller than the conventional width "Li". Thus, the following formula must be satisfied:

$$2\times(Po/Ps)\times t>(n-1)(Po^2-Ps^2)^{1/2}$$

Consequently, the following formula [3] can be derived:

$$t>\frac{n-1}{2}\frac{Ps}{Po}\sqrt{Po^2-Ps^2} \tag{3}$$

With the above described formula [2] and formula [3], the upper and lower limits of the side length "t" of the linear print head module 1 can be represented by the following formula [4]

$$\frac{n-1}{2}\frac{Ps}{Po}\sqrt{Po^2-Ps^2}<t\leq n\frac{Ps}{Po}\sqrt{Po^2-Ps^2} \tag{4}$$

$$\text{Here, } A=\frac{Ps}{Po}\sqrt{Po^2-Ps^2}$$

$$\text{Then, } (n-1)\frac{A}{2}<t\leq nA \tag{4'}$$

can be derived. That is, the maximum reduction in size can be obtained in case of t=nA, and Lh will become equal to Lj in case of t=(n−1)A/2.

Incidentally, in the above description, the distance "D" between the neighboring subordinate print head modules S in the main scanning direction is assumed to "t" which is the side length of the linear print head module 1. However, the above described effect of the depicted embodiment can also be acknowledged even if the distance "D" is zero in the conventional print head.

In this way, the print head according to the present embodiment can provide the smaller nozzle pitch length in the main scanning direction. Therefore, it is possible to reduce variation in landing point of ink droplet onto the recording sheet, the variation being caused by variation in main scanning speed. In particular, if the present embodiment is applied to the serial scanning type printer, scanning stroke can be reduced by an amount corresponding to the reduction in nozzle array length. Consequently, substantial printing speed can be increased.

Incidentally, in the print head according to the above described embodiment, six nozzles are formed in the linear print head module 1, and the "Po" is four times as long as "Ps". However, the present embodiment is not limited to these nozzle numbers and dimension.

Figure 5:
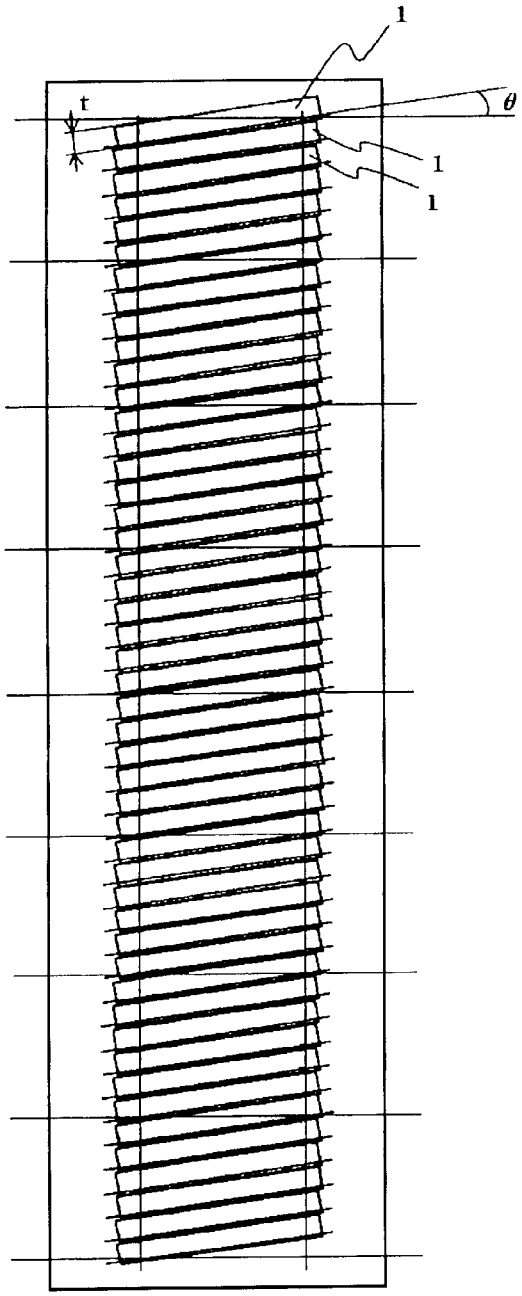
FIG. 5 is a plan view showing one example of a print head according to the first embodiment.

FIG. 5 shows a detailed example of the print head according to the present embodiment. The print head includes a plurality of linear print head modules 1 arrayed in the auxiliary scanning direction. Each linear print head module 1 is formed with 64 nozzles (n=64) with the nozzle pitch Po=6/300 inches and short side length 5 mm (t=5 mm). Each of the linear head modules 1 is slanted by an angle θ of about 9.594° with respect to the main scanning direction. With this arrangement, a pitch of the scanning lines, i.e., the distance between the neighboring nozzles in the auxiliary scanning direction is 1/300 inches (Ps=1/300 inches). In other words, 300 dpi printing can be performed with the single main scanning. Thus, the print head is available for the serial scanning type printer. Further, the print head is particularly available as a print head for high speed line printer, if the print head is immovable in the main scanning direction and is elongated to have a width substantially equal to a width of the recording sheet with the printing dot density on the recording sheet of 300 dpi in the auxiliary scanning direction and with the print dot pitch "Pr" of 1/300 inches in the auxiliary scanning direction.

In other words, a desired print dot density can be obtained with a single scanning by suitably setting the slanting angle θ of the linear head modules 1 so that the scanning pitch "Ps" (for example, 1/300 inches) on the recording sheet and the print dot density (for example 300 dpi) in the auxiliary scanning direction can be equal to each other.

Stated differently, if the print dot pitch on the recording sheet in the auxiliary scanning direction is "Pr", the slanting angle θ of the linear print head modules 1 and their short side length "t" are determined provided that the determined "θ" and "t" can satisfy the relationship of Ps=Pr, and provided that the linear print head modules are linearly arrayed in the auxiliary scanning direction with a distance of "nPr".

Further, if the nozzle pitch "Po" is defined by the following equation [5], concurrent driving timing of the nozzle cells 150 shown in FIG. 2 can be provided with the condition that the printing is performed with the printing dot density of 300 dpi in the main scanning direction and the dots are aligned in the auxiliary scanning direction. With this arrangement, a driving timing circuit can be simplified. In the following equation [5], "k" represents a natural number, "Ph" represents a predetermined print dot pitch in the main scanning direction. For example, the pitch "Po" is about 0.515 mm provided that k=6 and Ph=1/300 inches.

$$Po=\sqrt{(k^{2+1})Ph^2} \qquad [5]$$

Figure 6:
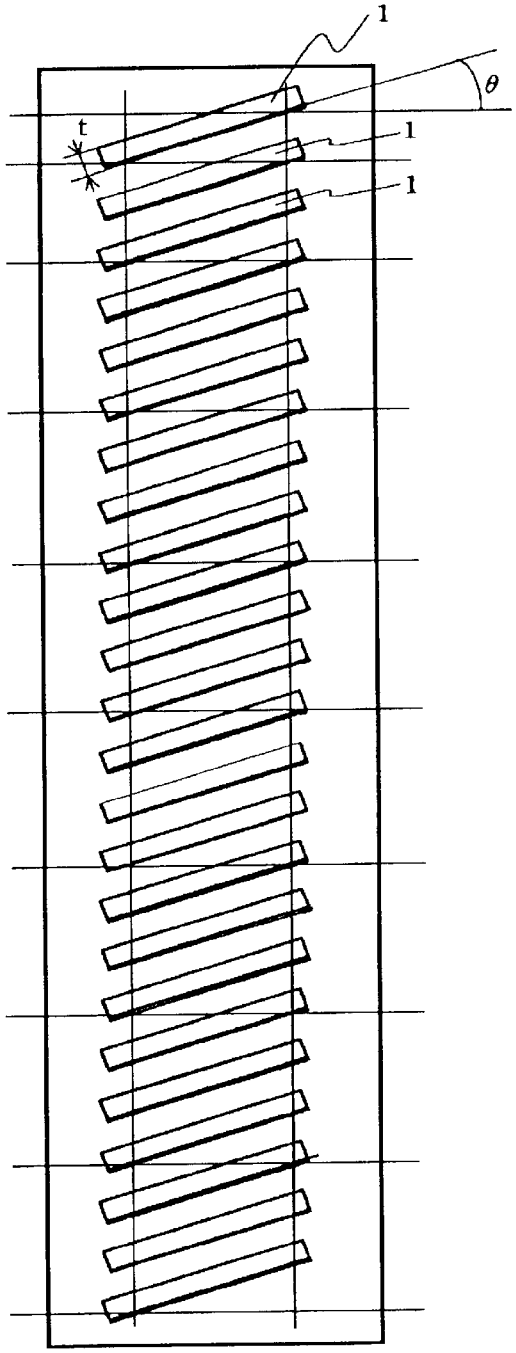
FIG. 6 is a plan view showing another example of a print head according to the first embodiment.

FIG. 6 shows another example of the print head according to the embodiment, in which the linear print head modules 1 are the same as those used in FIG. 5. However, each linear head module 1 is slanted by an angle θ of 19.47° with respect to the main scanning direction, so that the scanning pitch "Ps" in the auxiliary scanning direction can be 2/300 inches. Printing with an interlace scanning can be performed with a serial printer of 300 dpi with the print head of FIG. 6. Thus, improved imaging quality can be obtained.

That is, in case of the interlace scanning printing with the scanning pitch "Ps" being "m" times as large as the print dot pitch "Pr" in the auxiliary scanning direction, an inclination angle θ of the linear print head module 1 with respect to the main scanning direction should be "$\theta=\mathrm{Sin}^{-1}(mPr/Po)$", provided that "m" is a natural number of 2 or more.

Figure 7:
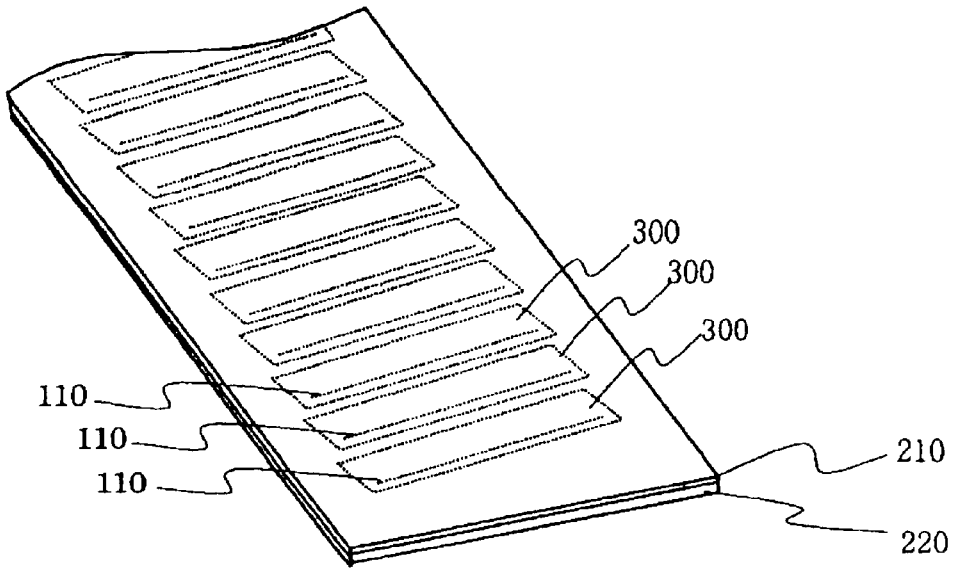
FIG. 7 is a perspective view showing a print head according to a second embodiment of the present invention.
Figure 8:
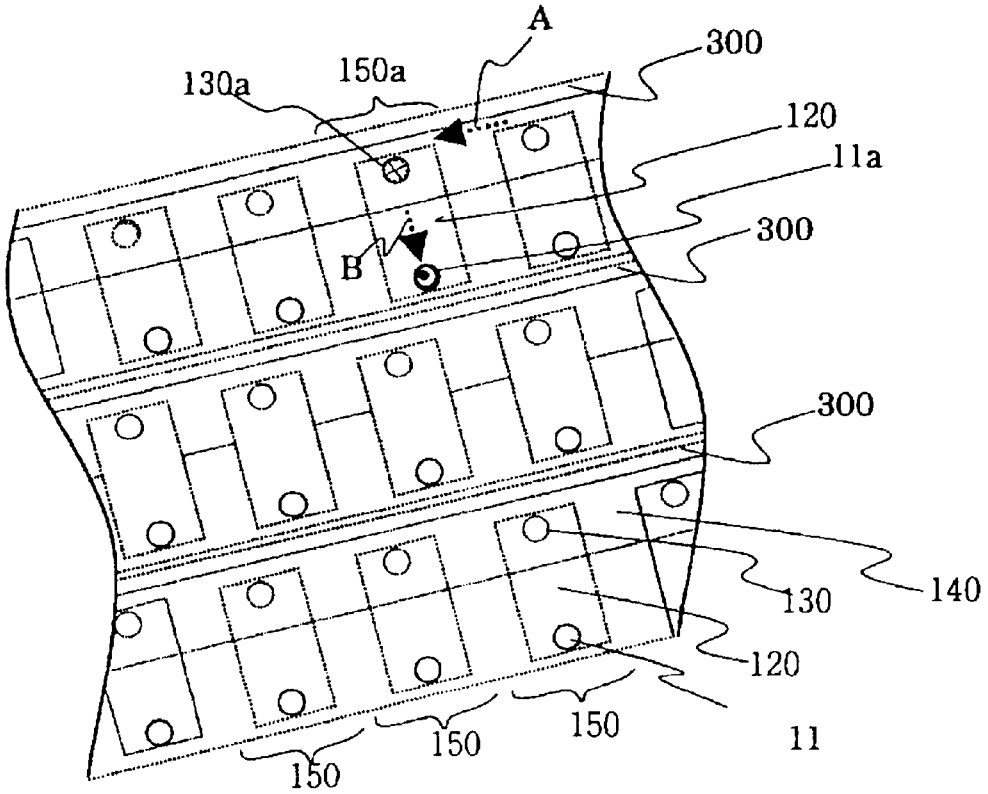
FIG. 8 is an enlarged view showing an essential portion of the print head of FIG. 7.

A print head according to a second embodiment is shown in FIGS. 7 and 8. The second embodiment does not employ the plurality of the linear print head modules 1 of the first embodiment. Instead, an elongated orifice plate 210 is provided in which a plurality of nozzles 11 are formed to provide a plurality of nozzle arrays 110. Moreover, ink chambers 120 and manifolds 140 are not formed in the modules but are formed in a plurality of elongated lamination layers constituting an integral lamination body 220, each layer being subjected to patterning. This lamination body 220 is bonded to a lower face of the orifice plate 210. On the other hand, driving elements 300 for changing internal volumes of the ink chambers 120 in response to the print signal are constituted into a plurality of driving element modules 300 corresponding to each nozzle array 110. These modules 300 are bonded to a lower face of the lamination body 220.

The second embodiment is particularly useful if yieldability or productivity is not influenced by the combination of the elongated orifice plate 210 and the elongated lamination body 220, even though yieldability of the driving element module may be lowered if the module is elongated. For the formation of the high quality image, precise alignment of the nozzles are required. In this connection, the second embodiment would be advantageous over the combination of the linear print head modules of the first embodiment in that a plurality of nozzles can be accurately formed in a single plate by etching, perforation, laser machining or electroforming process.

In the second embodiment, only the driving elements are constituted into modules, and other components are provided in the elongated plate member. However, other components can be constituted into modules, otherwise the yieldability is lowered in case of the elongated arrangement.

Figure 9:
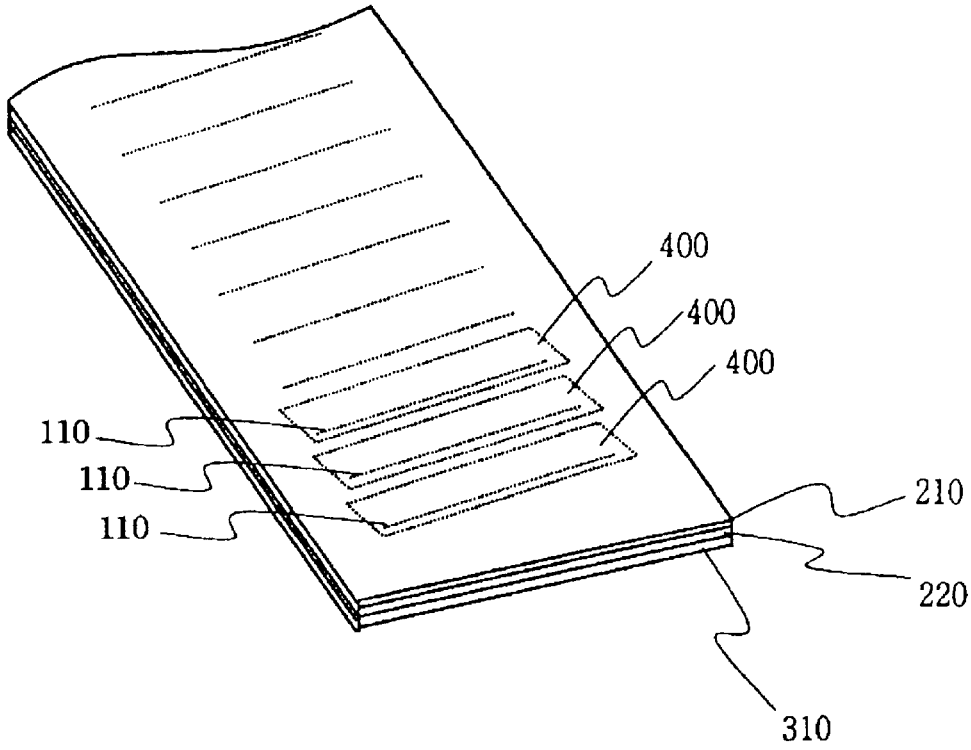
FIG. 9 is a perspective view showing a print head according to a third embodiment of the present invention.
Figure 10:
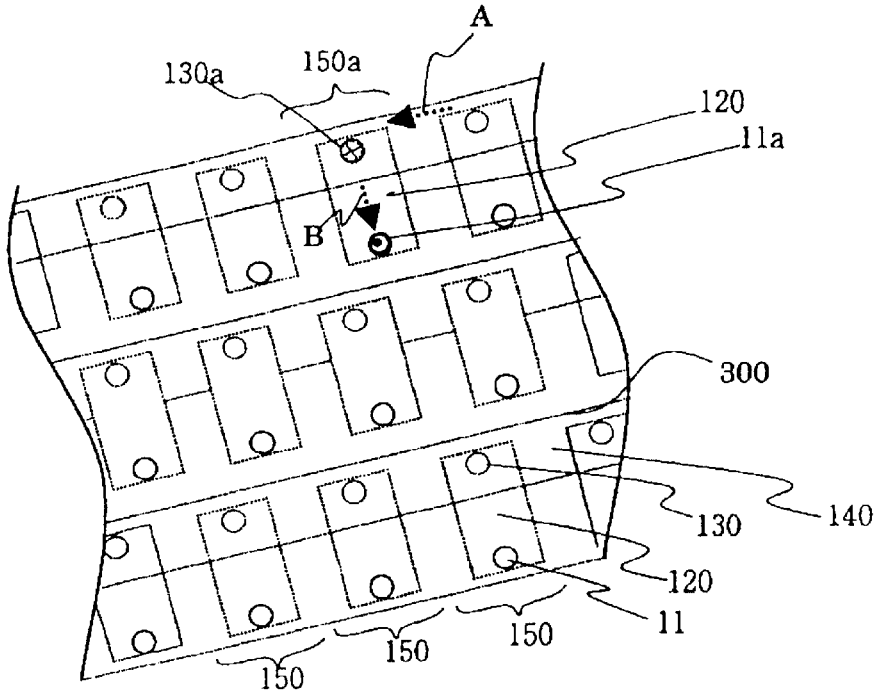
FIG. 10 is an enlarged view showing an essential portion of the print head of FIG. 9.

A print head according to the third embodiment is shown in FIGS. 9 and 10. In contrast to the second embodiment in which any one of the elements are constituted into module, the third embodiment does not provide any modules, yet producing the head at high yieldability. The third embodiment pertains to an elongated print head including an elongated orifice plate 210, an elongated lamination body 220, and an elongated integrated circuit board 310 stacked to each other in this order. The orifice plate 210 is formed with a plurality of nozzles, and the lamination body 220 forms therein ink chambers 120 and manifolds 140. The integrated circuit board 310 constitutes the driving elements.

The structure of the third embodiment can be simulated to an imaginary linear print head module 400 wherein a plurality of nozzle cells 150 are arrayed in the main scanning direction with the nozzle pitch "Po" and with openings of "n" pieces of nozzles 11. The above described side length "t", the inclination angle "θ" and formula [1] through [5] can be applied to the imaginary linear print head module 400 so as to provide a print head with the reduced nozzle pitch in the main scanning direction.

Figure 11:
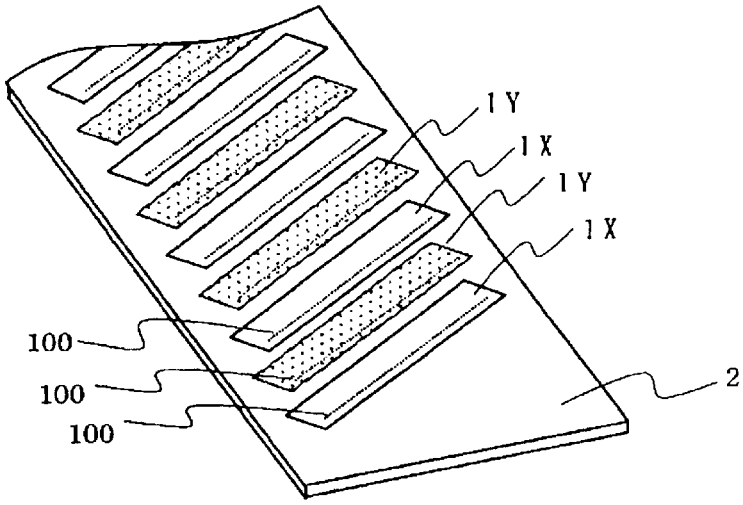
FIG. 11 is a perspective view showing a print head according to a fourth embodiment of the present invention.

An elongated print head for an ink jet printer according to a fourth embodiment of the present invention will be described with reference to FIGS. 11 through 14(*b*). The print head shown in FIG. 11 is for two color printing oriented such that the illustrated side is in confrontation with a sheet similar to FIG. 1.

The print head includes a holder 2 and a plurality of linear print head modules 1X for one specific color such as black, and a plurality of linear print head modules 1Y for another specific color such as red. These print head modules 1X and 1Y are held on the holder 2. These print head modules 1X and 1Y are alternatingly arrayed in a predetermined positional relationship and have structure equal to each other. Each print head module 1 is formed with "n" pieces of nozzles arrayed in a nozzle array 100 with a nozzle pitch Po (FIG. 13).

Figure 12:
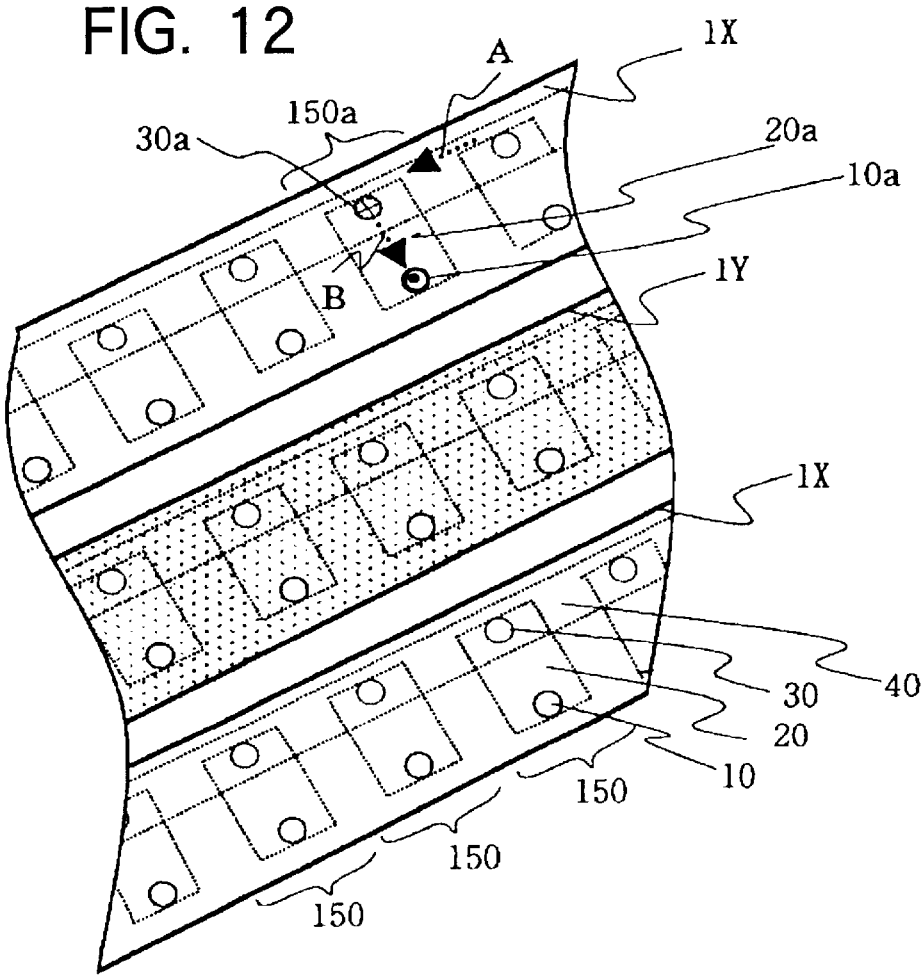
FIG. 12 is an enlarged view showing an essential portion of the print head of FIG. 11.

Enlarged 3 rows of linear print head modules 1X and 1Y are exemplarily shown in FIG. 12. Structure of the linear print head module 1X and 1Y is the same as that of the linear print head module 1 of the first embodiment except that the black ink is supplied to the linear print head module 1X and red ink is supplied to the linear print head module 1Y.

In accordance with the operation principle of the nozzle cells 150, 150*a* in a manner the same as that in the first embodiment, black ink and red ink are ejected from the linear print head modules 1X and 1Y, respectively based on the print signals, so that two color image is produced on the printing sheet in accordance with relative scanning motion of the print head with respect to the sheet.

Figure 13:
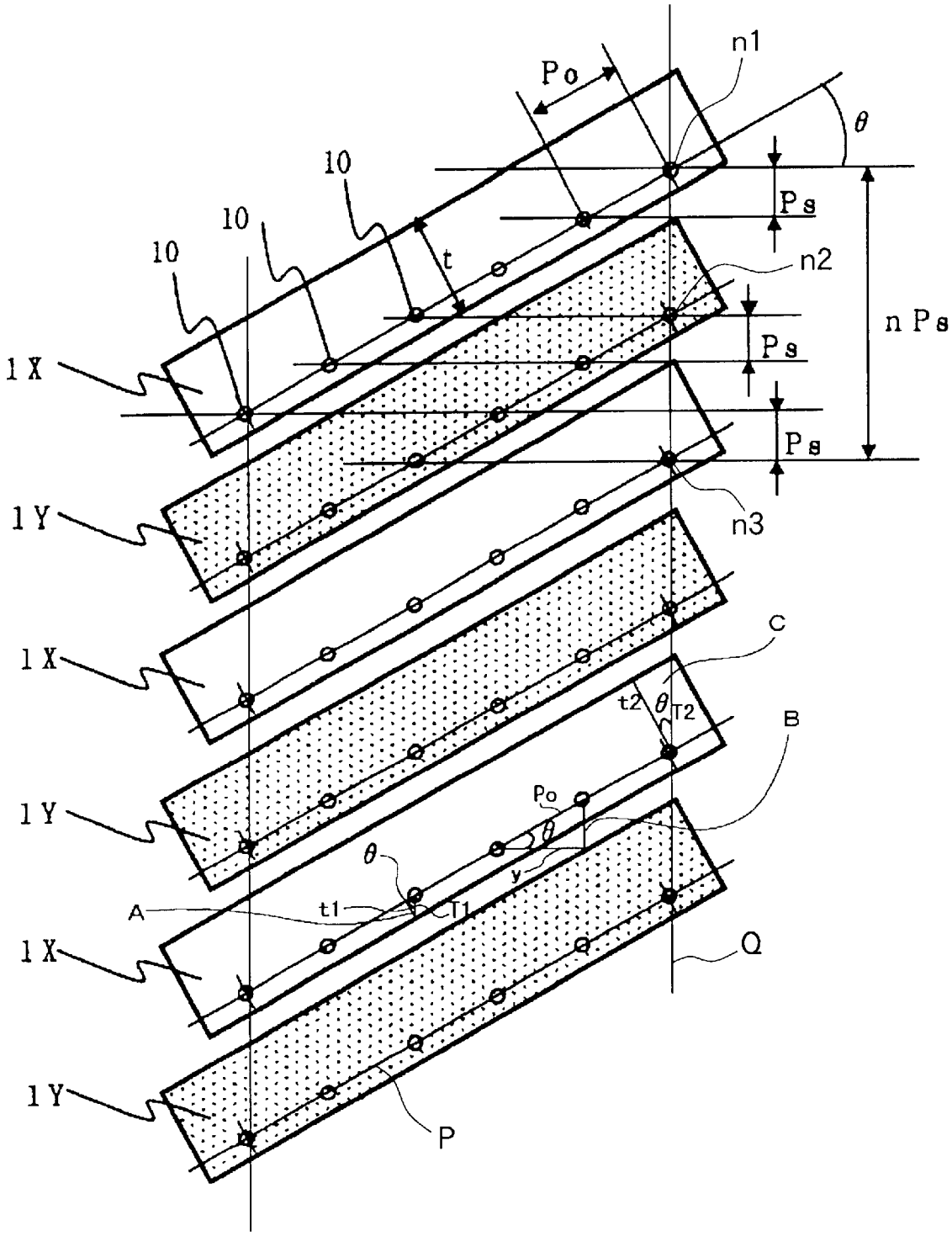
FIG. 13 a schematic view showing an array of linear print head modules and dimension in the print head of the fourth embodiment.

Dimension and positional relationship of the linear print head modules 1X and 1Y is shown in FIG. 13. The linear print head modules 1X and 1Y has generally rectangular shape and has a width "t" i.e., a minor side length of a rectangle. The print head module 1X, 1Y is formed with "n" pieces of nozzles 10, in FIG. 13, six nozzles are shown, spaced away from each other by an equal interval, i.e., a pitch length of "Po". The width "t" is determined by the following formula [6] corresponding to the formula [1]:

$$(n-1)\frac{A}{2m} < t \leq (n/m)A \qquad [6]$$

Here, "A" is represented as follows:

$$A = \frac{Ps}{Po}\sqrt{Po^2 - Ps^2}$$

Further, the slanting angle of the array of the nozzles with respect to the main scanning direction is represented by the same equation in the first embodiment. That is, angle $\theta = \mathrm{Sin}^{-1}(Ps/Po)$. Here, "Ps" designates a pitch (resolution) of the scanning lines to perform printing with the single main scanning of the print head. N pieces of the slanted linear print head modules 1X are arrayed in the auxiliary scanning direction with a pitch of "nPs". Further, N pieces of the slanted linear print head modules 1Y are arrayed in the auxiliary scanning direction in alternating fashion with the print head modules 1X.

According to this print head, black scanning lines with the pitch Ps can be provided by the black ink ejection from each of the nozzles 10 of the linear print head modules 1X, and red scanning lines with the pitch Ps can be provided by the red ink ejection from each of the nozzles 10 of the linear print head modules 1Y. The printed width in the auxiliary scanning direction is approximately N×(nPs).

Figure 14:
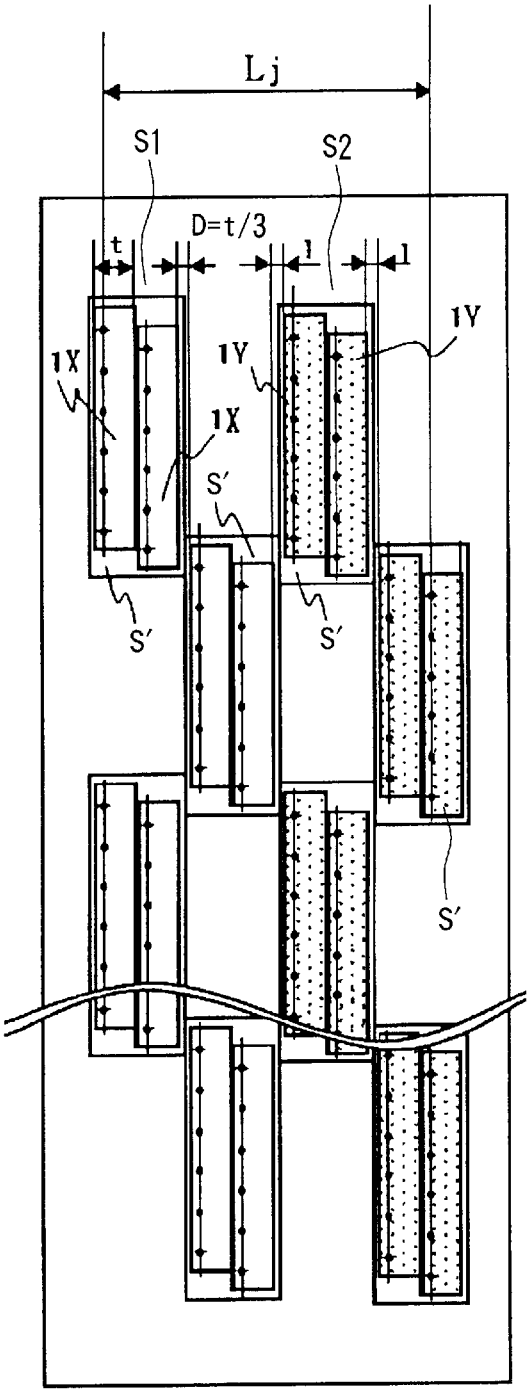
FIG. 14 (a) PRIOR ART
FIG. 14(*a*) is a schematic plan view showing a conventional two color print head.
Figure 14:
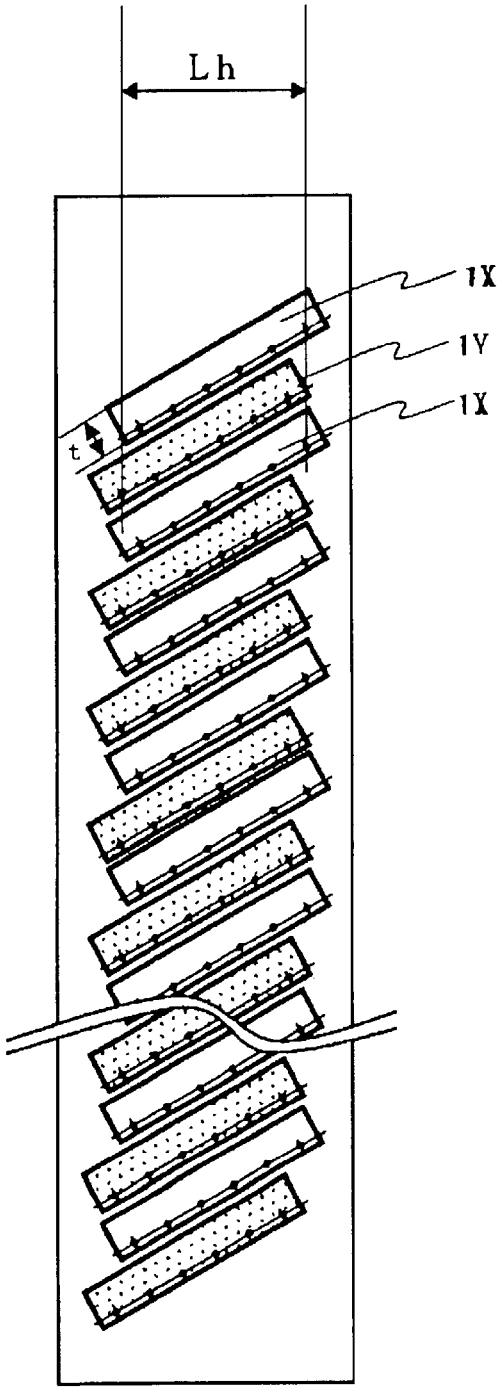

In FIGS. 14(*a*) and 14(*b*), for the purpose of comparison shown are the print head in which linear print head modules 1 are arrayed in a conventional manner and the print head of the fourth embodiment. Incidentally, both print heads provide the scanning pitch of "Ps", and the linear print head module 1 used in the conventional print head and the linear print head modules 1X and 1Y used in the fourth embodiment have the dimension and ink ejection characteristic the same as each other.

In FIG. 14(*a*), according to the conventional print head, two linear print head modules 1X are arrayed in the main scanning direction and displaced from each other in the auxiliary scanning direction for black color so as to provide the scanning pitch of "Ps", thereby providing the subordinate print head module S'. Similarly two linear print head modules 1Y are arrayed in the main scanning direction and displaced from each other in the auxiliary scanning direction for red color. If "m" kinds of colors are used, 2m pieces of print head modules are required.

In order to provide continuity in nozzles in the auxiliary scanning direction, i.e., longitudinal direction of the print head, the subordinate print head modules S' are arranged in alternating staggered fashion such that the distance between the neighboring subordinate print head modules S is greater than the width of the subordinate print head module S in the main scanning direction. Accordingly, an entire length "Lj" of the nozzle array in the main scanning direction becomes large similar to FIG. 4(*a*).

On the other hand, according to the print head of the fourth embodiment, the nozzle array length "Lh" in the main scanning direction is extremely smaller than the conventional length "Lj", and the length can be reduced to almost half the "Lj".

Here, a maximum length and a minimum length of the minor side "t", i.e., width of the linear print head module 1 is derived by the following manner. In FIG. 13, three right triangles A, B and C are considered in a manner the same as FIG. 3, and the above described equations (1) and (2) can be derived.

$$T1=(t1\times Po)/y \qquad (1)$$

$$T2=(t2\times Po)/y \qquad (2)$$

Here, if the print head is for the color printer with multiple "m" colors, a distance between the nozzles of the linear print head modules for the identical color (for example, a distance between a nozzle nl of 1X and a nozzle n3 of 1X) in the auxiliary scanning direction is "nPs". Therefore, a distance between the nozzles of the neighboring print head modules for the different colors (for example the distance between the nozzle nl of 1X and a nozzle n2 of 1Y) in the auxiliary scanning direction is "(n/m)Ps". If this distance "(n/m)Ps" is smaller than (T1+T2), the linear print head modules 1X and 1Y can be arranged side by side in the auxiliary scanning direction. Thus, the following formula (3') can be established.

$$T1+T2 \leqq (n/m)Ps \qquad (3')$$

With the equations (1) and (2), T1+T2=(t1+t2)×Po/y=t×po/y. Accordingly, the following formula (4') can established:

$$t\times Po/y \leqq (n/m)Ps \qquad (4')$$

Thus, "t" is represented as the following formula [7] corresponding to the formula [2]:

$$t \leq (n/m)\frac{Ps}{Po}y = (n/m)\frac{Ps}{Po}\sqrt{Po^2 - Ps^2} \quad [7]$$

On the other hand, in the conventional print head shown in FIG. 14(*a*), the subordinate print head module S' includes (Po/Ps) pieces of linear print head modules 1 so that the scanning pitch can be "Ps" provided that the nozzle pitch of the linear print head module 1 is "Po". Further, provided that the distance "D" between the trailing edge of the linear print head module 1 of the precedent subordinate print head module S and the leading edge of the linear print head module of the subsequent subordinate print head module S is "t/3", the entire width "Lj" of the conventional print head is as follows:

$$Lj=2m\times(Po/Ps)\times t \quad (5')$$

On the other hand, the entire width "Lh" of the print head according to the fourth embodiment is;

$$Lh=(n-1)(Po^2-Ps^2)^{1/2}$$

The fourth embodiment provides advantage if the entire width "Lh" is smaller than the conventional width "Lj". Thus, the following formula must be satisfied:

$$2m\times(Po/Ps)\times t>(n-1)(Po^2-Ps^2)^{1/2}$$

Consequently, the following formula [8] corresponding to the formula [3] can be derived:

$$t > \frac{n-1}{2m}\frac{Ps}{Po}\sqrt{Po^2 - Ps^2} \quad [8]$$

With the above described formula [7] and formula [8], the upper and lower limits of the side length "t" of the linear print head module 1 can be represented by the following formula [9] corresponding to the formula [4]:

$$\frac{n-1}{2m}\frac{Ps}{Po}\sqrt{Po^2 - Ps^2} < t \leq (n/m)\frac{Ps}{Po}\sqrt{Po^2 - Ps^2} \quad [9]$$

$$\text{Here, } A = \frac{Ps}{Po}\sqrt{Po^2 - Ps^2}$$

$$\text{Then, } (n-1)\frac{A}{2m} < t \leq (n/m)A \quad [9']$$

can be derived. That is, the maximum reduction in size can be obtained in case of t=(n/m)A, and Lh will become equal to Lj in case of t=(n−1)A/2m.

In this way, the print head according to the fourth embodiment can provide the smaller nozzle pitch length in the main scanning direction. Therefore, it is possible to reduce variation in landing point of ink droplet onto the recording sheet, the variation being caused by variation in main scanning speed. In particular, if the fourth embodiment is applied to the serial scanning type printer, scanning stroke can be reduced by an amount corresponding to the reduction in nozzle array length. Consequently, substantial printing speed can be increased.

Figure 15:
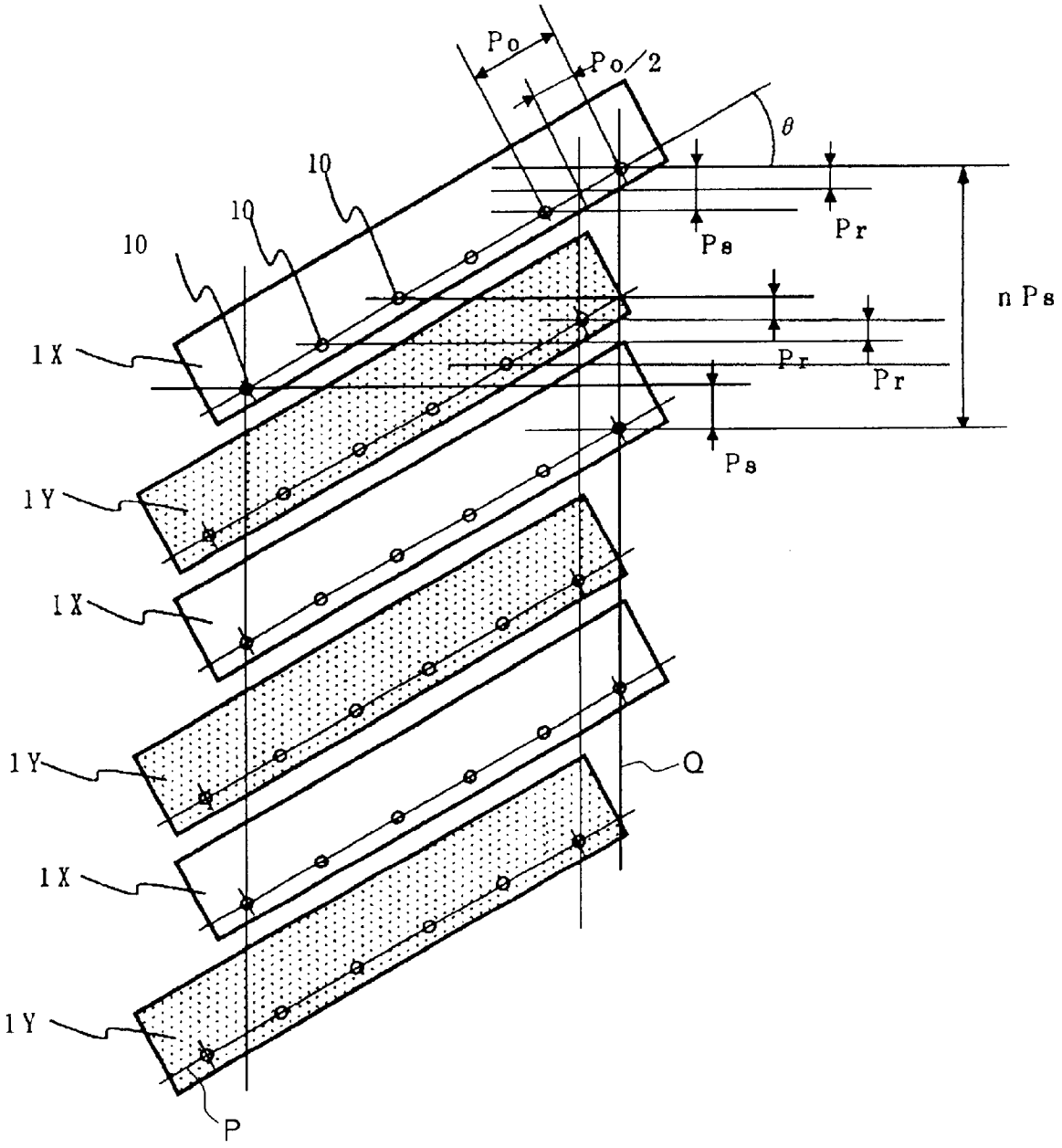
FIG. 15 is a plan view showing a modification to the print head of the fourth embodiment.

FIG. 15 shows a modification to the print head of the fourth embodiment. The linear print head modules 1Y are displaced by Po/2 with respect to the linear print head modules 1X in the direction of the nozzle array P slanted by the angle θ with respect to the main scanning direction. In the modification, the linear print head modules Y are displaced leftwardly in FIG. 15. However, these modules Y can be displaced rightwardly in FIG. 15.

With this arrangement, each red color scanning line formed by each linear print head module 1Y is positioned between black color scanning lines formed by the linear print head modules 1X, so that the neighboring red and black scanning lines provide a pitch of "Pr" as shown in FIG. 15. Thus, mixture of black and red colors can be avoided when both linear print head modules 1X and 1Y eject respective inks concurrently. Accordingly, printing quality can be improved.

Figure 16:
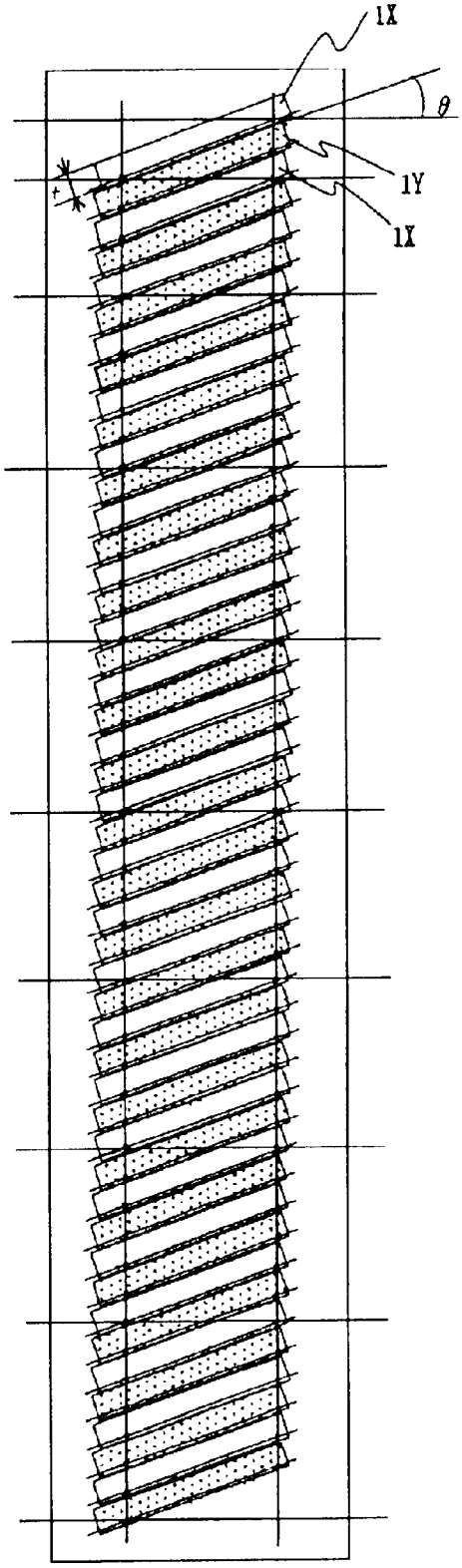
FIG. 16 is a plan view showing a second modification to the fourth embodiment, and corresponding to the modification shown in FIG. 5.

FIG. 16 shows a second modification to the fourth embodiment, and this modification corresponds to the modification shown in FIG. 5. In FIG. 16, the print head includes a plurality of linear print head modules 1X and 1Y alternatingly arrayed in the auxiliary scanning direction. Each linear print head module 1X, 1Y is formed with 64 nozzles (n=64) with the nozzle pitch Po=6/300 inches and short side length 5 mm (t=5 mm). Each of the linear head modules 1X, 1Y is slanted by an angle θ of about 19.47° with respect to the main scanning direction. With this arrangement, a pitch of the scanning lines, i.e., the distance between the neighboring nozzles in the auxiliary scanning direction is 1/150 inches (Ps=1/150 inches). In other words, 150 dpi printing can be performed with the single main scanning for each color. The print head is available for the serial scanning type printer. Further, the print head is particularly available as a two color print head for a high speed line printer, if the print head is elongated to have a width substantially equal to a width of the recording sheet with the print dot density on the recording sheet of 150 dpi in the auxiliary scanning direction and with the print dot pitch "Pr" of 1/150 inches in the auxiliary scanning direction. Moreover interlace scanning is achievable by the serial printer providing 300 dpi., which enhances imaging quality. Furthermore, the above described equation [5] can also be applied to the fourth embodiment.

Figure 17:
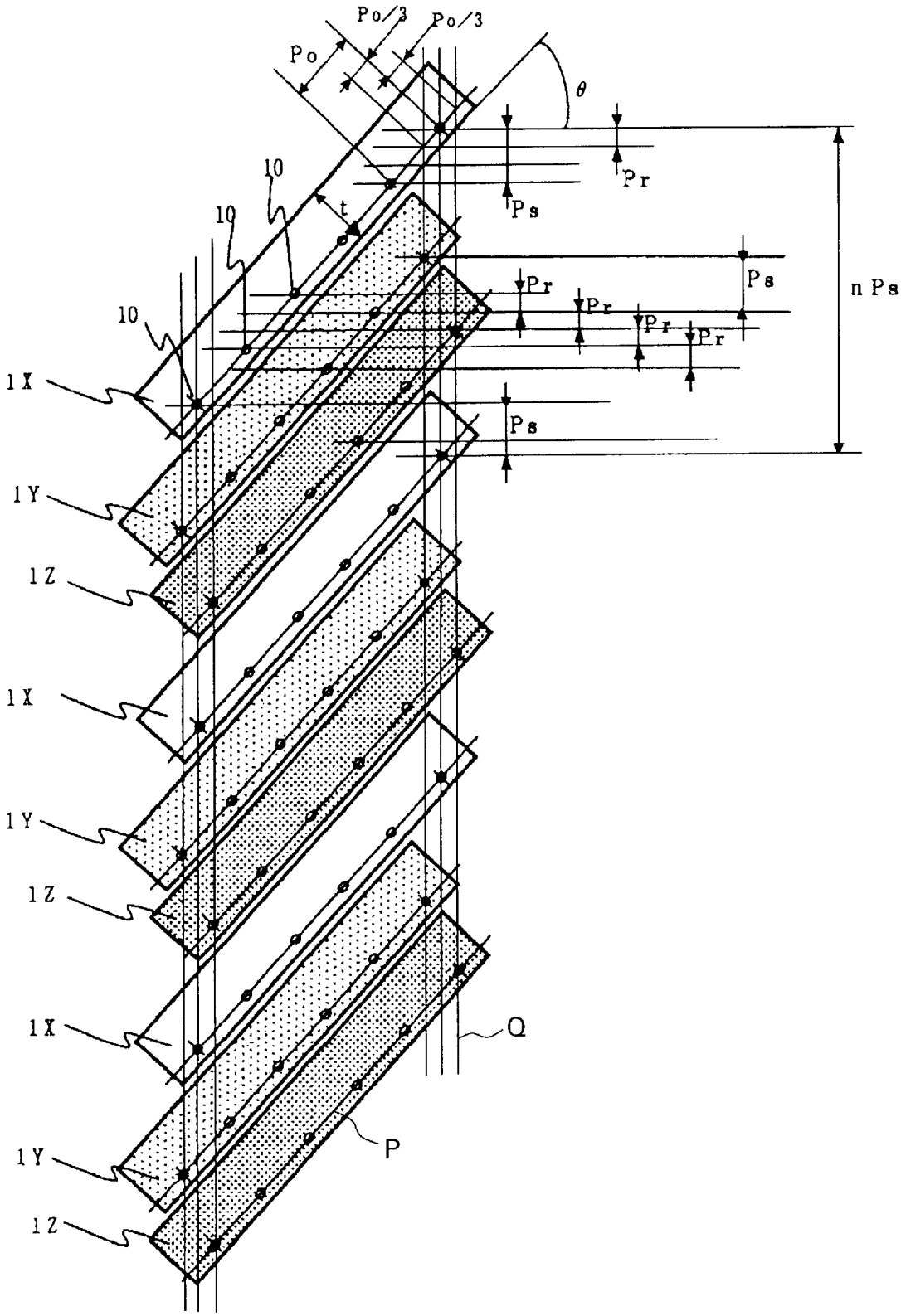
FIG. 17 is a plan view showing an example of a print head for three colors according to the fourth embodiment.

FIG. 17 shows an example of a print head for three colors according to the fourth embodiment. This print head includes linear print head modules 1X, 1Y, 1Z for black color, red color and blue color, respectively. Each linear print head module has a short side length (width) of "t", and is formed with "n" pieces of nozzles 10 with the nozzle pitch of "Po". Further, "t" is in the range of the following formula in accordance with the formula [9]:

$$(n-1)A/(2\times3)<t\leqq(n/3)A$$

Incidentally, $A=(Ps/Po)(Po^2-Ps_2)^{1/2}$

Further, each linear print head module 1X, 1Y, 1Z is inclined such that corresponding nozzle array is equally inclined by an angle θ with respect to the main scanning direction such that $\theta=Sin^{-1}(Ps/Po)$ as described above.

N pieces of linear print head modules 1X are arrayed in the auxiliary scanning direction with the module pitch of nPs in the auxiliary scanning direction. Further one linear print head module 1Y and one linear print head module 1Z are positioned between the neighboring linear print head module 1X and 1X.

With this arrangement, black scanning lines are formed on the printing sheet with the scanning pitch of "Ps" by the linear print head modules 1X, and similarly, red scanning lines and blue scanning lines are formed with the same scanning pitch of "Ps" by the linear print head modules 1Y and 1Z, respectively.

Further, the linear print head modules 1Y are displaced leftwardly in FIG. 17 by Po/3 with respect to the linear print head modules 1X in the direction of nozzle array "P", and the linear print head modules 1Z are displaced rightwardly in FIG. 17 by Po/3 with respect to the liner print head modules 1X in the direction of nozzle array "P". Accordingly, black, red, blue scanning lines are formed with the equal pitch Pr, and color mixture can be avoided during concurrent ink ejections from the respective linear print head modules 1X, 1Y, 1Z, thereby improving printing quality.

Figure 18:
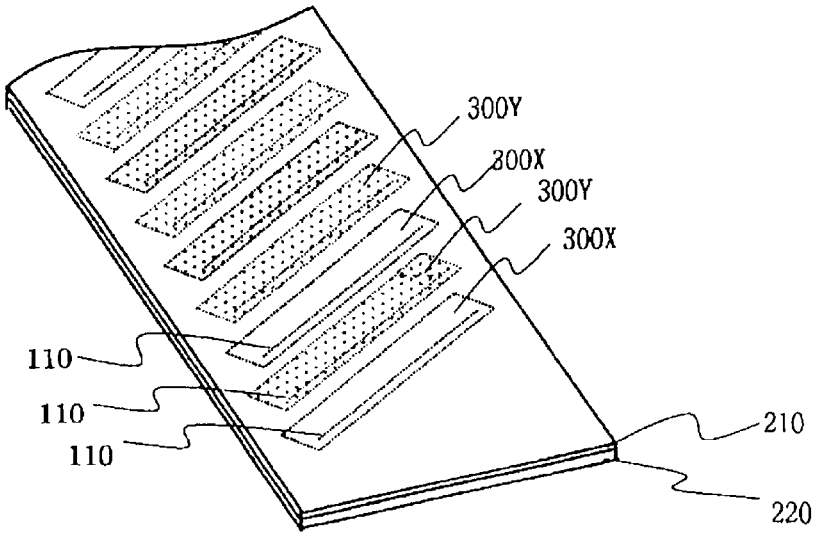
FIG. 18 is a perspective view showing a print head according to a fifth embodiment of the present invention.
Figure 19:
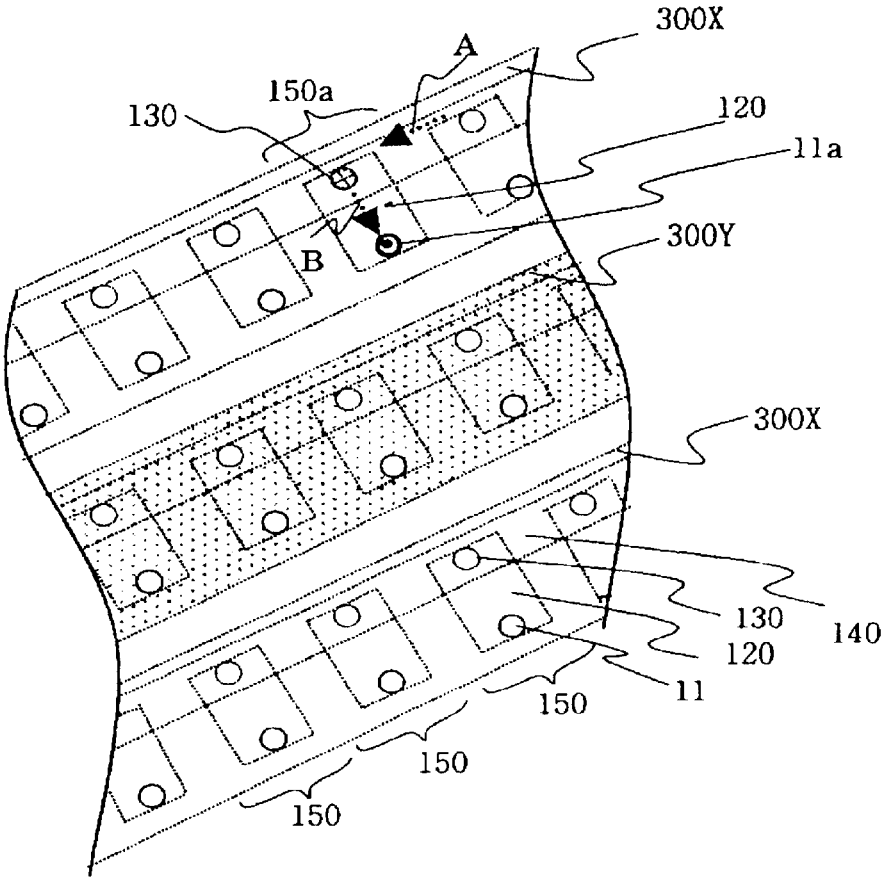
FIG. 19 is an enlarged view showing an essential portion of the print head of FIG. 18.

A print head according to a fifth embodiment is shown in FIGS. 18 and 19. The fifth embodiment pertains to a two color print head similar to the fourth embodiment. Similar to the second embodiment shown in FIGS. 7 and 8, the fifth embodiment does not employ the plurality of the linear print head modules 1. Instead, the second embodiment includes an elongated orifice plate 210 and a lamination body the same as those in the second embodiment. Further, similar to the second embodiment, driving element modules 300X and 300Y are bonded to the lower face of the lamination body 220, 300X being for the black ink ejection and 300Y being for the red ink ejection.

The fifth embodiment is particularly useful if yieldability or productivity is not influenced by the combination of the elongated orifice plate 210 and the elongated lamination body 220, even though yieldability of the driving element modules may be lowered if the module is elongated.

In the fifth embodiment, only the driving elements are constituted into modules, and other components are provided in the elongated plate member. However, other components can be constituted into modules, otherwise the yieldability is lowered in case of the elongated arrangement.

Figure 20:
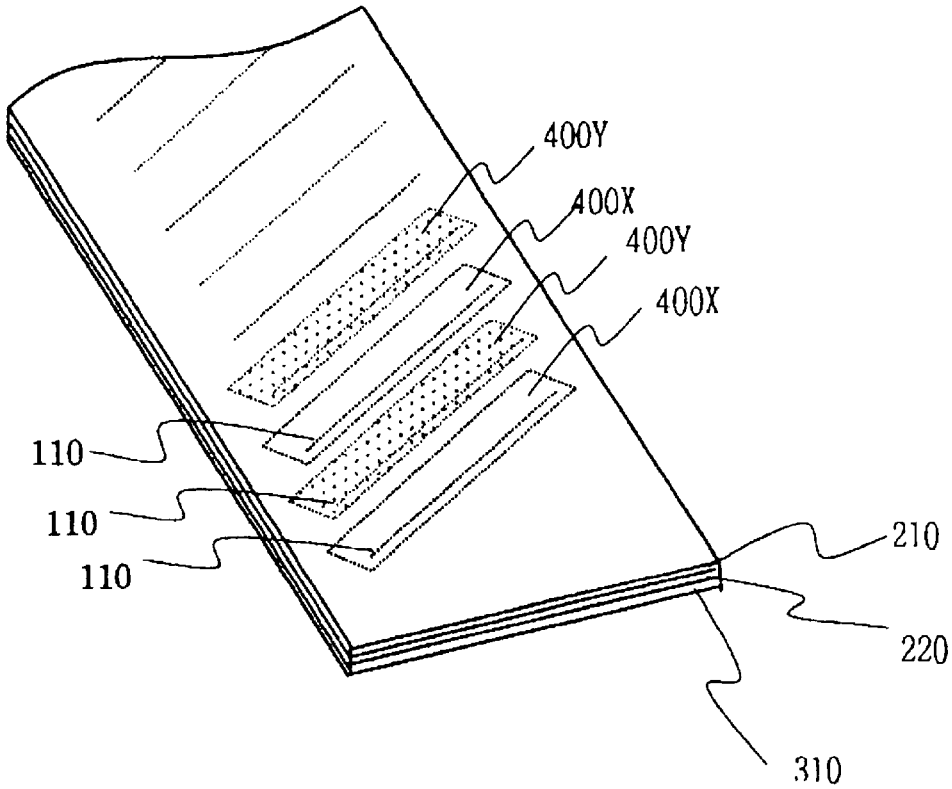
FIG. 20 is a perspective view showing a print head according to a sixth embodiment of the present invention.
Figure 21:
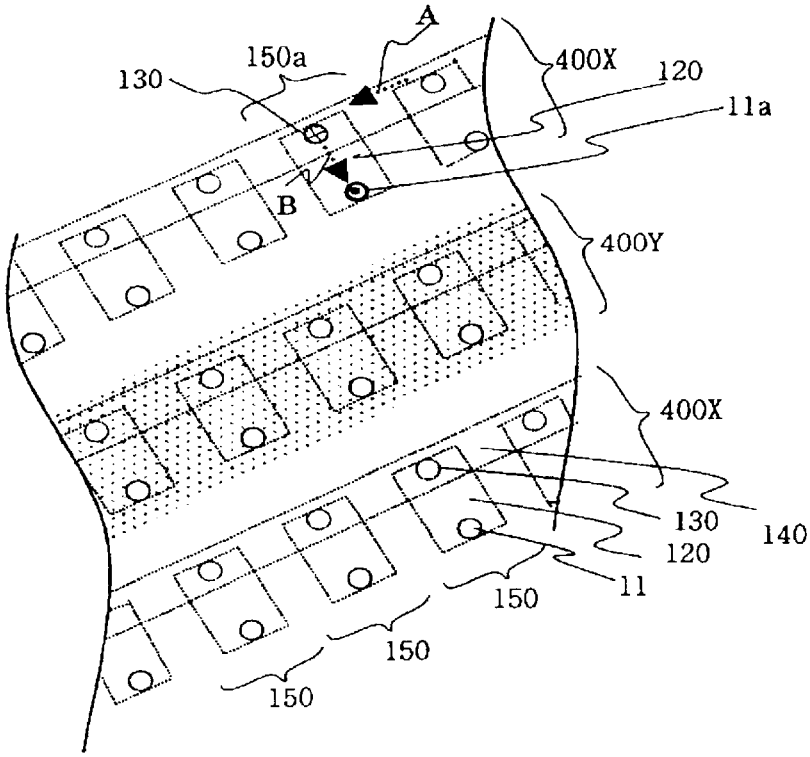
FIG. 21 is an enlarged view showing an essential portion of the print head of FIG. 20.

A two color print head according to the sixth embodiment is shown in FIGS. 20 and 21. The sixth embodiment corresponds to the third embodiment shown in FIGS. 9 and 10 in that the sixth embodiment does not provide any modules, yet producing the head at high yieldability. The sixth embodiment pertains to an elongated print head including an elongated orifice plate 210, an elongated lamination body 220, and an elongated integrated circuit board 310 stacked to each other in this order in a manner the same as the third embodiment.

The structure of the sixth embodiment can be simulated to an imaginary linear print head module 400X, 400Y wherein a plurality of nozzle cells 150 are arrayed in the main scanning direction with the nozzle pitch "Po" and with "n" pieces of nozzles 11. The above described side length "t", the inclination angle "θ" and formula [5] through [9] can be applied to the imaginary linear print head module 400X and 400Y so as to provide a print head with the reduced nozzle pitch in the main scanning direction.

While the invention has been described in detail and with reference to specific embodiments thereof, it would be apparent to those skilled in the art that various changes and modifications may be made therein.

For example, in the above described linear print head modules, the nozzles are aligned linearly in a line. However, the nozzles can be offset from the line within a predetermined displacement in the auxiliary scanning direction in order to improve printing performance or productivity.

Further, the present invention is not limited to the print head for the ink jet printer, but can be applied to other kind of print head having an array of printing cells such as heat sensitive recording system and a wire dot type recording system.

What is claimed is:

1. A print head for a printer, the print head providing a scanning line in a main scanning direction on a printing sheet, comprising:

a plurality of linear print head modules arrayed side by side in an auxiliary scanning direction perpendicular to the main scanning direction, each linear print head module having a plurality of printing elements arrayed in a slanting direction with respect to the main scanning direction by an angle "θ", print head module having a width "t" perpendicular to the direction of the array of the printing elements, and the printing elements providing a first pitch "Po" between neighboring printing elements in the direction of the array and a second pitch "Ps" in the auxiliary scanning direction for defining scanning pitch on the printing sheet, the plurality of linear print head modules being also slanted by the angle "θ" with respect to the main scanning direction;

the width "t" and the angle "θ" being defined by the following formulas:

$$(n-1)\frac{A}{2} < t \le nA \text{ and}$$

$$\theta = \mathrm{Sin}^{-1}(Ps/Po)$$

where n is the numbers of printing elements, $$A = (Ps/Po)(Po^2 - Ps^2)^{1/2}$$

and a distance between the neighboring linear print head modules in the auxiliary scanning direction being "nPs".

2. The print head as claimed in claim 1, wherein the printer is an ink jet printer and the printing elements are nozzles for ejecting ink droplets therefrom.

3. The print head as claimed in claim 2, wherein "Po" represents a nozzle pitch in the direction of array, the nozzle pitch being defined by the following equation;

$$Po = \sqrt{(k^{2+1)Ph^2}}$$

where "k" represents a natural number, and "Ph" is a predetermined printed dot pitch in the main scanning direction.

4. A print head for an ink jet printer, the print head providing a scanning line in a main scanning direction on a printing sheet, comprising:

a plurality of nozzle cell arrays extending in a first direction slanting by an angle "θ" with respect to the main scanning direction and arranged side by side in an auxiliary scanning direction perpendicular to the main scanning direction, each nozzle cell array including a plurality of nozzle cells aligned side by side in the first direction, and each nozzle cell providing an ink chamber formed with a nozzle, an ink inlet for directing an ink into the ink chamber, and a manifold for introducing the ink into the ink inlet, each nozzle cell array being regarded as an imaginary linear print head module;

each imaginary linear print head module having a plurality of nozzles arrayed in the first direction by a combination of each nozzle of each nozzle cell, the imaginary linear print head module having a width "t" perpendicular to the first direction, and the plurality of nozzles providing a first pitch "Po" between neighboring nozzles in the first direction and a second pitch "Ps" in the auxiliary scanning direction for defining scanning pitch on the printing sheet, the width "t" and the angle "θ" being defined by the following formulas:

$$(n-1)\frac{A}{2} < t \le nA \text{ and}$$

$$\theta = \mathrm{Sin}^{-1}(Ps/Po)$$

where n is the numbers of nozzles, $$A = (Ps/Po)(Po^2 - Ps^2)^{1/2};$$

and a distance between the neighboring imaginary linear print head modules in the auxiliary scanning direction being "nPs".

5. The print head as claimed in claim 4, wherein "Po" represents a nozzle pitch in the first direction, the nozzle pitch being defined by the following equation;

$$Po=\sqrt{(k^{2+1)Ph^2}}$$

where "k" represents a natural number, and "Ph" is a predetermined printed dot pitch in the main scanning direction.

6. A print head for a color ink jet printer, the print head ejecting first, second, and m-th kinds of color inks and providing a scanning line in a main scanning direction on a printing sheet, comprising:

a plurality of linear print head modules arrayed side by side in an auxiliary scanning direction perpendicular to the main scanning direction for ejecting "m" kinds of colors of different inks, each linear print head module having a plurality of nozzles arrayed in a slanting direction with respect to the main scanning direction by an angle "θ" to provide an array of the nozzles, the linear print head module having a width "t" perpendicular to the direction of the nozzle array, and the nozzles providing a first pitch "Po" between neighboring nozzles in the direction of the nozzle array and a second pitch "Ps" in the auxiliary scanning direction for defining scanning pitch on the printing sheet, the plurality of linear print head modules being also slanted by the angle "θ" with respect to the main scanning direction;

the width "t" and the angle "θ" being defined by the following formulas:

$$(n-1)\frac{A}{2m} < t \le (n/m)A$$

$$\theta=\mathrm{Sin}^{-1}(Ps/Po)$$

where n is the numbers of nozzles, $$A=(Ps/Po)(Po^2-Ps^2)^{1/2},$$

and a distance between the neighboring linear print head modules for the identical color in the auxiliary scanning direction being "nPs", and (m−1) pieces of linear print head modules for (m−1) colors being positioned in the distance.

7. The print head as claimed in claim 6, wherein "Po" represents a nozzle pitch in the direction of nozzle array, the nozzle pitch being defined by the following equation;

$$Po=\sqrt{(k^{2+1)Ph^2}}$$

where "k" represents a natural number, and "Ph" is a predetermined printed dot pitch in the main scanning direction.

8. The print head as claimed in claim 6, wherein a linear print head module for i-th color is displaced from a linear print head module for the first color by (i−1)(Po/m) in the direction of the nozzle array, wherein "i" is a natural number and smaller than or equal to "m", whereby scanning lines of different colors can have equal pitch in the auxiliary scanning direction.

9. A print head for a color ink jet printer, the print head ejecting first, second, and m-th kinds of color inks and providing a scanning line in a main scanning direction on a printing sheet, comprising:

a plurality of nozzle cell arrays extending in a first direction slanting by an angle "θ" with respect to the main scanning direction and arranged side by side in an auxiliary scanning direction perpendicular to the main scanning direction, each nozzle cell array including a plurality of nozzle cells aligned side by side in the first direction, and each nozzle cell providing an ink chamber formed with a nozzle, an ink inlet for directing an ink into the ink chamber, and a manifold for introducing the ink into the ink inlet, each nozzle cell array being regarded as an imaginary linear print head module;

each imaginary linear print head module having a plurality of nozzles arrayed in the first direction by a combination of each nozzle of each nozzle cell, the imaginary linear print head module having a width "t" perpendicular to the first direction, and the plurality of nozzles providing a first pitch "Po" between neighboring nozzles in the first direction and a second pitch "Ps" in the auxiliary scanning direction for defining scanning pitch on the printing sheet, the width "t" and the angle "θ" being defined by the following formulas:

$$(n-1)\frac{A}{2m} < t \le (n/m)A$$

and $$\theta=\mathrm{Sin}^{-1}(Ps/Po)$$

where n is the numbers of nozzles, $$A=(Ps/Po)(Po^2-Ps^2)^{1/2};$$

and a distance between the neighboring imaginary linear print head modules for the identical color in the auxiliary scanning direction being "nPs", and (m−1) pieces of imaginary linear print head modules for (m−1) colors being positioned in the distance.

10. The print head as claimed in claim 9, wherein "Po" represents a nozzle pitch in the direction of nozzle array of the imaginary linear print head module, the nozzle pitch being defined by the following equation;

$$Po=\sqrt{(k^{2+1)Ph^2}}$$

where "k" represents a natural number, and "Ph" is a predetermined printed dot pitch in the main scanning direction.

11. The print head as claimed in claim 9, wherein an imaginary linear print head module for i-th color is displaced from an imaginary linear print head module for the first color by (i−1)(Po/m) in the direction of the nozzle array, wherein "i" is a natural number and smaller than or equal to "m", whereby scanning lines of different colors can have equal pitch in the auxiliary scanning direction.

* * * * *